US006056591A

United States Patent [19]

Liao

[11] Patent Number: 6,056,591

[45] Date of Patent: May 2, 2000

[54] STRUCTURE OF A WIRE WINDING BOX

[76] Inventor: Sheng Hsin Liao, No.137, San Chun St., Shu Lin Jen, Taipei Hsien, Taiwan

[21] Appl. No.: 09/349,772

[22] Filed: Jul. 9, 1999

[30] Foreign Application Priority Data

Jun. 4, 1999 [TW] Taiwan ..... 88209138

[51] Int. Cl.[7] ..... H01R 13/72; H01R 11/00; H01R 3/00

[52] U.S. Cl. ..... 439/501; 439/502; 439/164

[58] Field of Search ..... 439/501, 164, 439/162, 20, 21, 22, 27, 502; 242/371, 385.1, 917

[56] References Cited

U.S. PATENT DOCUMENTS 5,684,883 11/1997 Chen ..... 381/187
5,701,981 12/1997 Marshall et al. ..... 191/12.4
5,796,047 8/1998 Sheng-Hsin ..... 174/135

*Primary Examiner*—Paula Bradley
*Assistant Examiner*—Edwin A. León
*Attorney, Agent, or Firm*—Rosenberg, Klein & Lee

[57] ABSTRACT

An improved structure of a wire winding box comprises a housing, a first communication cable, a second communication cable, a spiral spring, a first conductive disk, and a second conductive disk. The rotatable first conductive disk is installed with line groove for being inserted by the first communication cable and fixing blocks for fixing therewithin, two sides of the fixing block is alternatively arranged with a plurality of elastic conductive pieces each connected to the respective cable of the radiating cover, and the outer end of each conductive piece is inserted into the through hole and positioned in different radial positions. Thereby, the stability is improved. By the easily assembled conductive structure, the quality of communication is enhanced. Moreover, buckling groove and notch are installed around the periphery of the first conductive disk for matching with the buckling blocks on the lateral side of the housing. By this special buckling structure thereof, as the communication cable is pulled out with a predetermined distance, it will be buckled and the length is fixed temporarily for being used. While another length is pulled out, the buckling effect will be released automatically. Therefore, the communication will not be interrupted due to the elastic force of rewinding of the cable and the required length can be pull out conveniently.

15 Claims, 17 Drawing Sheets

STRUCTURE OF A WIRE WINDING BOX

BACKGROUND OF THE INVENTION

The present invention relates to a wire winding box, and especially to a wire winding box with communication cables which may rewind freely, thus it may be used in various communication device and avoid the improper winding of the cables, moreover, by the special design, each components may be arranged effectively in space.

Various kinds of wire winding boxes are developed for avoiding the improper winding of cables in communication devices. The structure of the wire winding box includes a housing, two conductive disks, at least one spiral spring, and two communication cables. One of the conductive disk is installed with a plurality of concentric conductive rings with unequal diameters and connected to each conductive wire of a communication cable. Another conductive disk is installed with a plurality of conductive pieces or metal rolling balls which are connected to the conductive wires of another communication cable. One rotary conductive disk is installed with a spiral spring and is wound by communication cable. Therefore, as two conductive disks are rotates respectively, an electric connection is retained. Thus, the communication cable can be pulled out or rewound. Such kinds of structures have been produced and sold in commercial market, and may be referred to U.S. Pat. No. 5,082,448, Taiwan Patent Nos. 87214430, 86221455, etc.

In the prior art wire winding box, a plurality of through holes are formed on a conductive disk for receiving springs, metal rolling balls and spacers. Since these components have small volumes and is elastic and easy to roll. Thus, the assembly work is complicated.

Besides, in the conventional wire winding box, as a communication cable is pulled out, it will present a tightening state due to the effect of elasticity so as to rewind the cable and thus the receiver will be pulled back. This is a great trouble to the user.

SUMMARY OF THE INVENTION

Accordingly, the object of the present invention is to provide an improved line groove for being inserted by the first communication cable and fixing blocks fixing therewithin. Two sides of the fixing block is alternatively arranged with a plurality of elastic conductive pieces each connected to the respective cable of the radiating cover, and the outer end of each conductive piece is inserted into the through hole and positioned in different radial positions. Thereby, the stability of electric connection is improved.

A further object of the present invention is to provide an improved structure of a wire winding box, by the special buckling structure thereof, as a communication cable is pulled out with a predetermined distance, it will be buckled and the length is fixed temporarily for being used. While another length is pulled out, the buckling effect will be released automatically. Therefore, the user will not be interrupted by the elastic force of rewinding of the cable and the required length can be pull out conveniently.

The present invention will be better understood and its numerous objects and advantages will become apparent to those skilled in the art by referencing to the following drawings in which:

DETAILED DESCRIPTION OF THE PREFERRED EMBODIMENT

Figure 1:
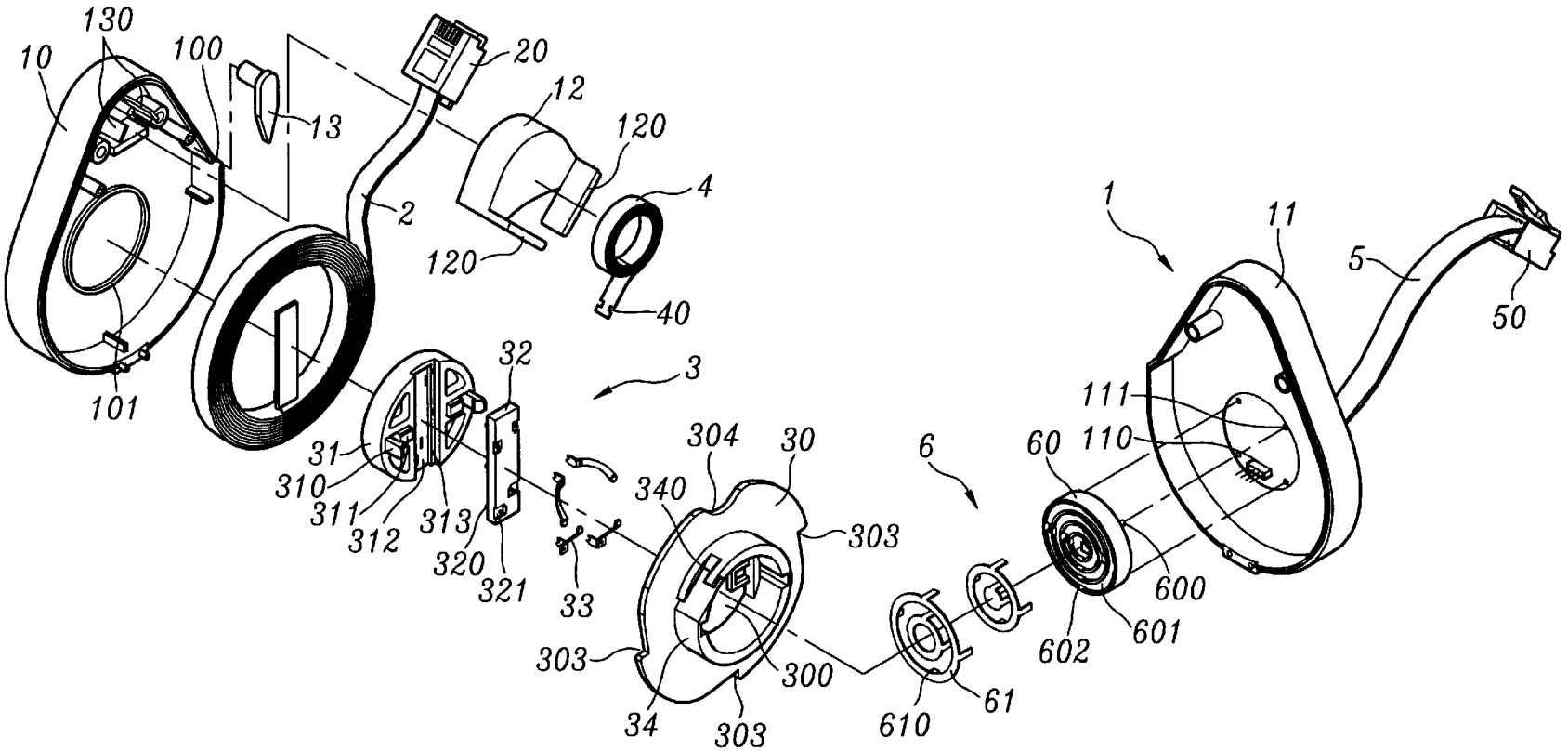
FIG. 1 is an exploded perspective view illustrated the structure of the first embodiment of the present invention.
Figure 2:
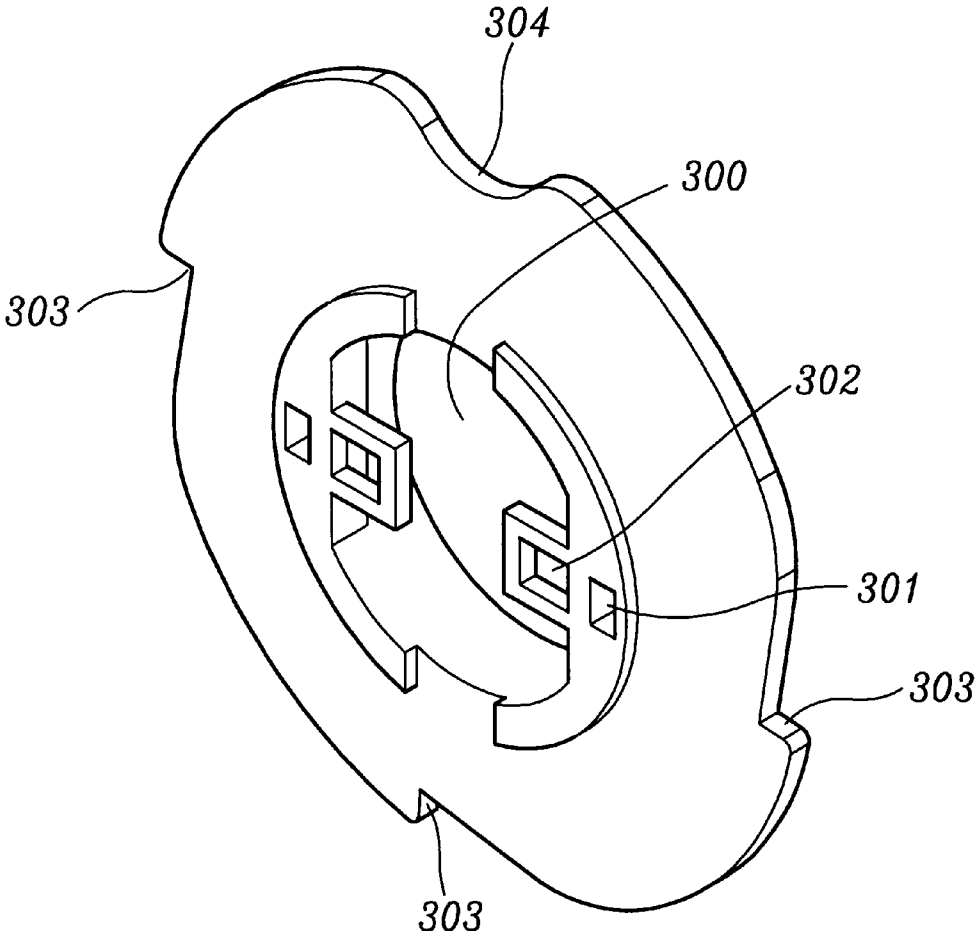
FIG. 2 is the rear exploded perspective view of the second conductive disk in the first embodiment of the present invention.

With reference to FIGS. 1~4, the improved structure of a wire winding box includes a housing 1, a first communication cable 2, a first conductive disk 3, a spiral spring 4, a second communication cable 5 and a second communication cable 6.

The housing 1 is formed by a first housing 10 and a second housing 11. In the proper position of the first housing 10 is installed with a line hole 100 for being protruded by the outer end of the plug 20 of the first communication cable 2.

A round ring 101 is formed on the center of the inner lateral surface of the housing. While a pad 12 is installed at the lateral side. Two stoppers 120 with a shape as Chinese word "八" are formed at the front edges of the two sides of the stopper 120. Thus, the pad 12 and the wall of the housing are formed with a space for receiving a spiral spring 4. The second housing 11 is also installed with a line hole 110 for being inserted by the second communication cable 5.

Figure 5:
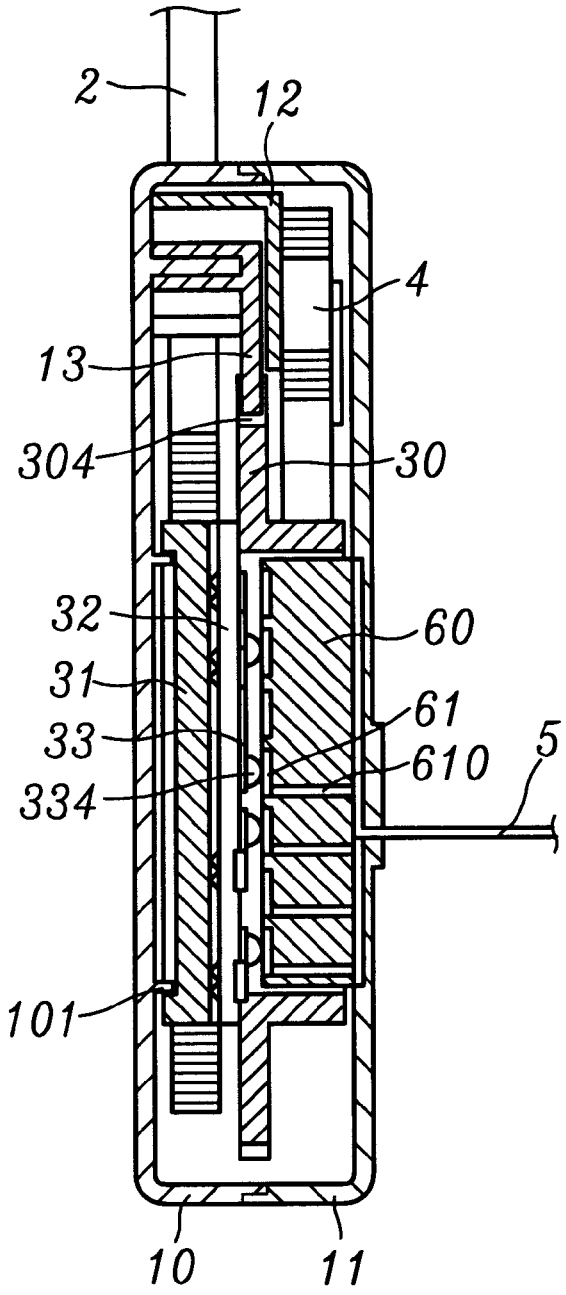
FIG. 5 is a cross sectional view showing the structure of the first embodiment.

In the first conductive disk 3, two buckling holes 301 and two positioning holes 302 are formed at two sides of one line (diameter line) passing through the center through hole 300 of the disk 30 (as shown in FIG. 1), and two hooks 310 and the two positioning blocks 311 are at two sides of a diameter line on a bearing seat 31, the diameter line on the bearing seat 31 is respective to the diameter line in disk 30. The hooks and the positioning block is engaged to the bottom of the disk 30 for being wound by the first communication cable 2. Then, the bearing seat 31 is engaged with the round ring 101 of the first housing 10 to rotate (as shown in FIG. 5). Moreover, as that shown in the second embodiment of FIGS. 7 and 8, the bearing seat is integrally formed at the bottom of the disk 30.

Figure 3:
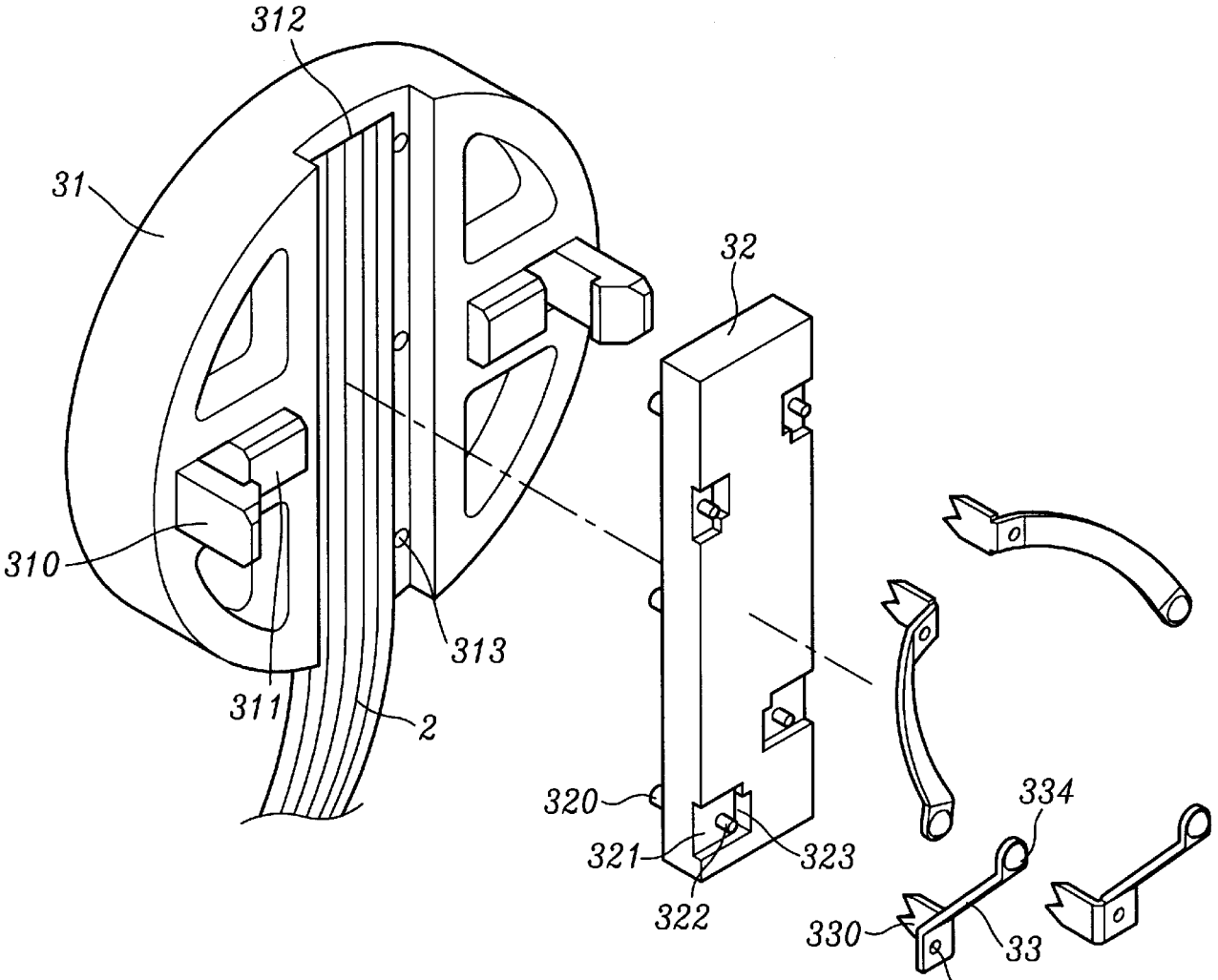
FIG. 3 is a partial perspective view illustrated the assembling of the conductive piece of the first embodiment according to the present invention.
Figure 4:
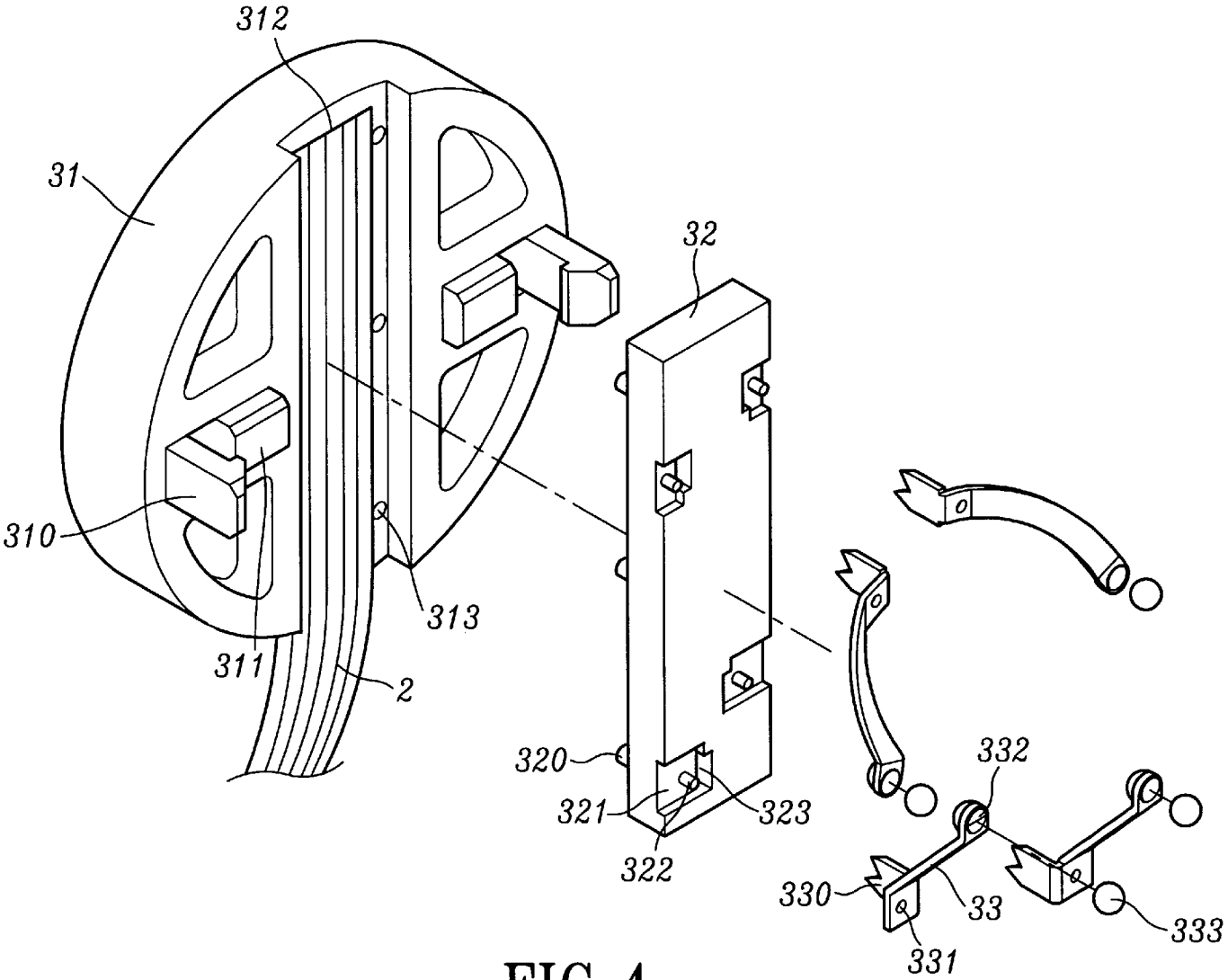
FIG. 4 is another partial perspective view illustrated the assembling of the conductive piece in another embodied application of the first embodiment according to the present invention.
Figure 7:
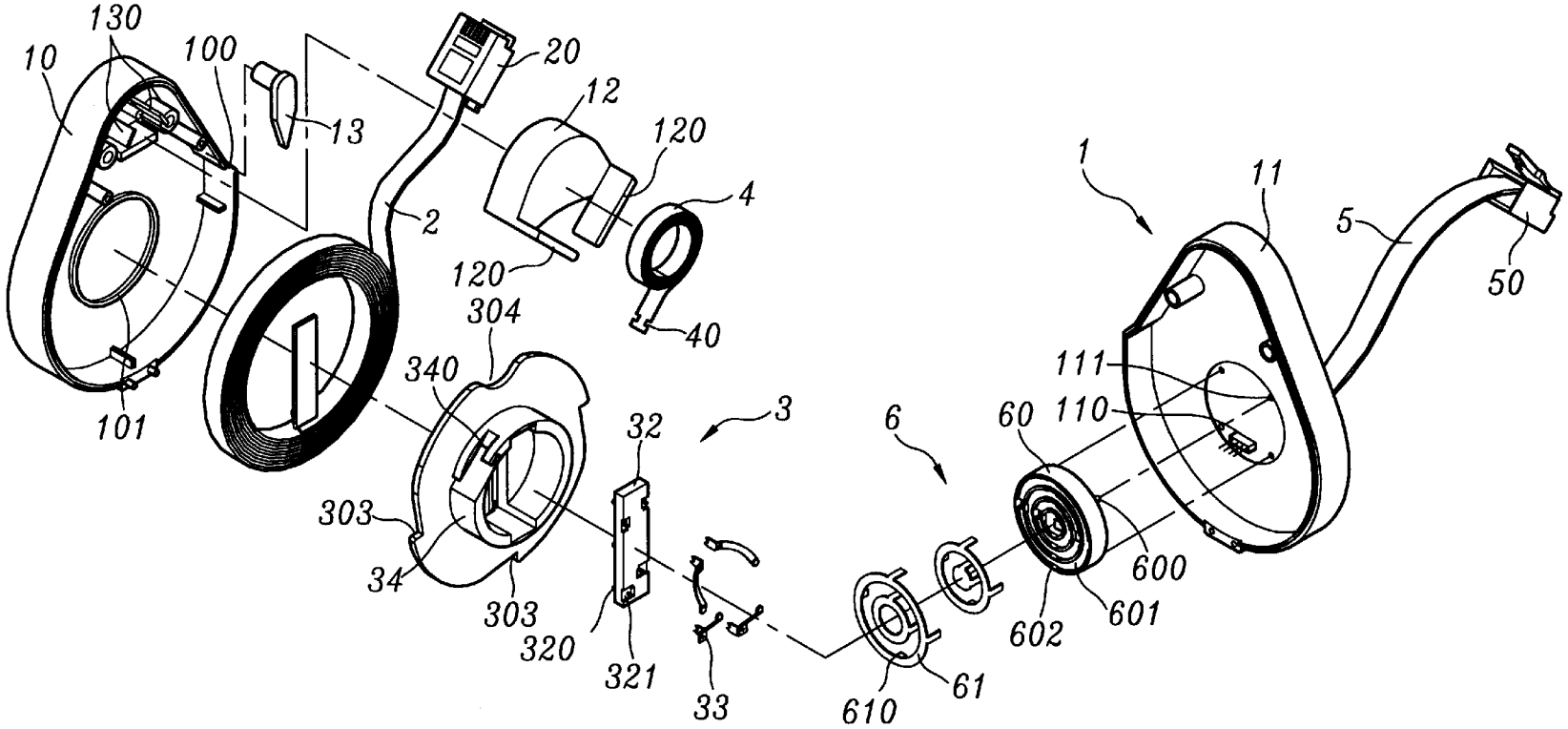
FIG. 7 is an exploded perspective view showing the structure of the second embodiment according to the present invention.
Figure 8:
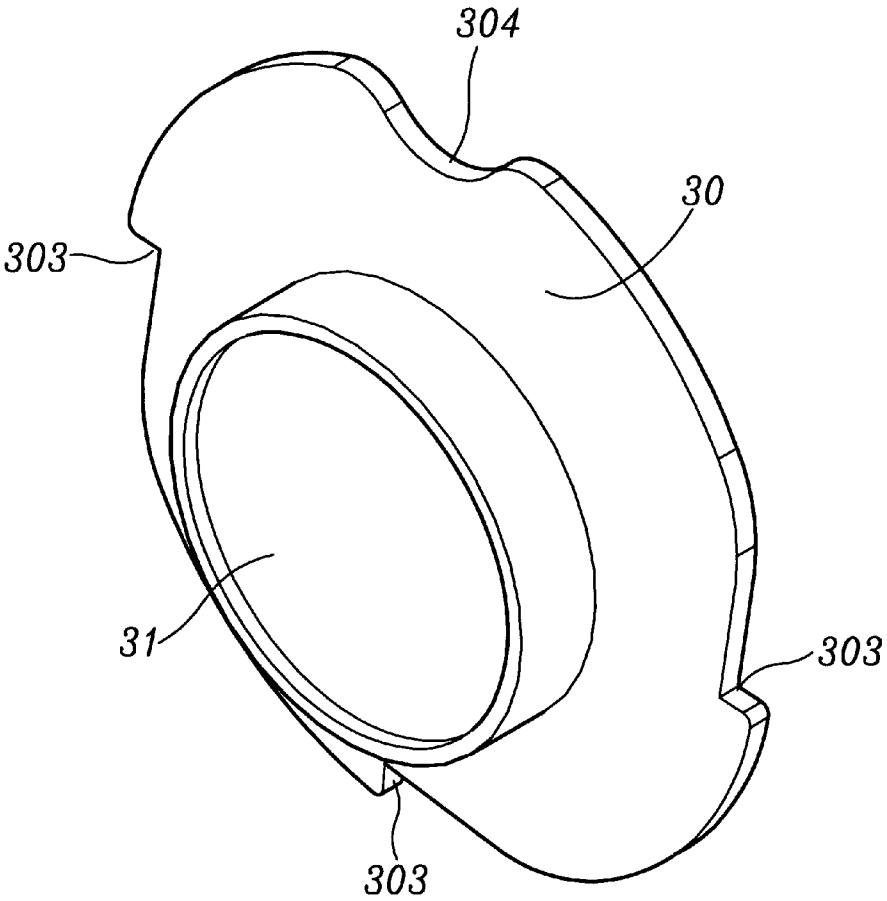
FIG. 8 is the rear exploded perspective view of the second conductive disk in the second embodiment of the present invention.
Figure 9:
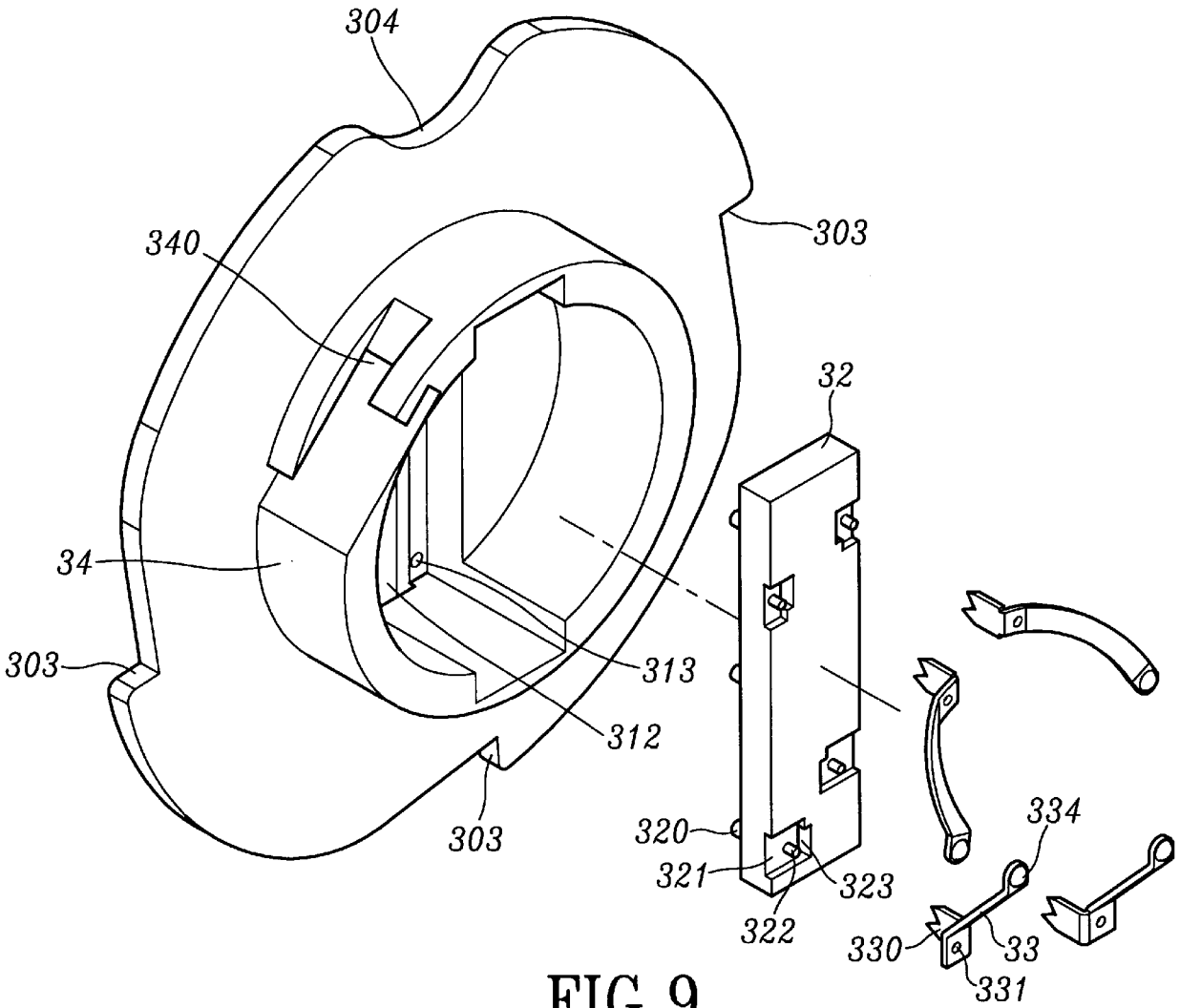
FIG. 9 is a partial perspective view illustrated the assembling of the conductive piece of the second embodiment according to the present invention.

As the first embodiment shown in FIGS. 1 and 3, and the second embodiment shown in FIGS. 7 and 9, a radial wire groove 312 is installed at the inner side of the bearing seat 31 for being inserted by the inner end of the first communication cable 2 (as shown in FIGS. 3 and 4). Two sides of the wire groove 312 are formed with inserting holes 313. A further positioning block 32 is installed for matching with the wire groove 312. The bottom of the positioning block 32 is installed with a plurality of inserting post 320 for being inserted into the inserting holes 313 so as to combine the bearing seat 31. A plurality of alternatively arranged positioning grooves 321 are formed at two sides of the positioning block. Each positioning groove 321 is installed with a positioning post 322 and through hole 323 for fixing a cambered elastic conductive piece 33.

Figure 10:
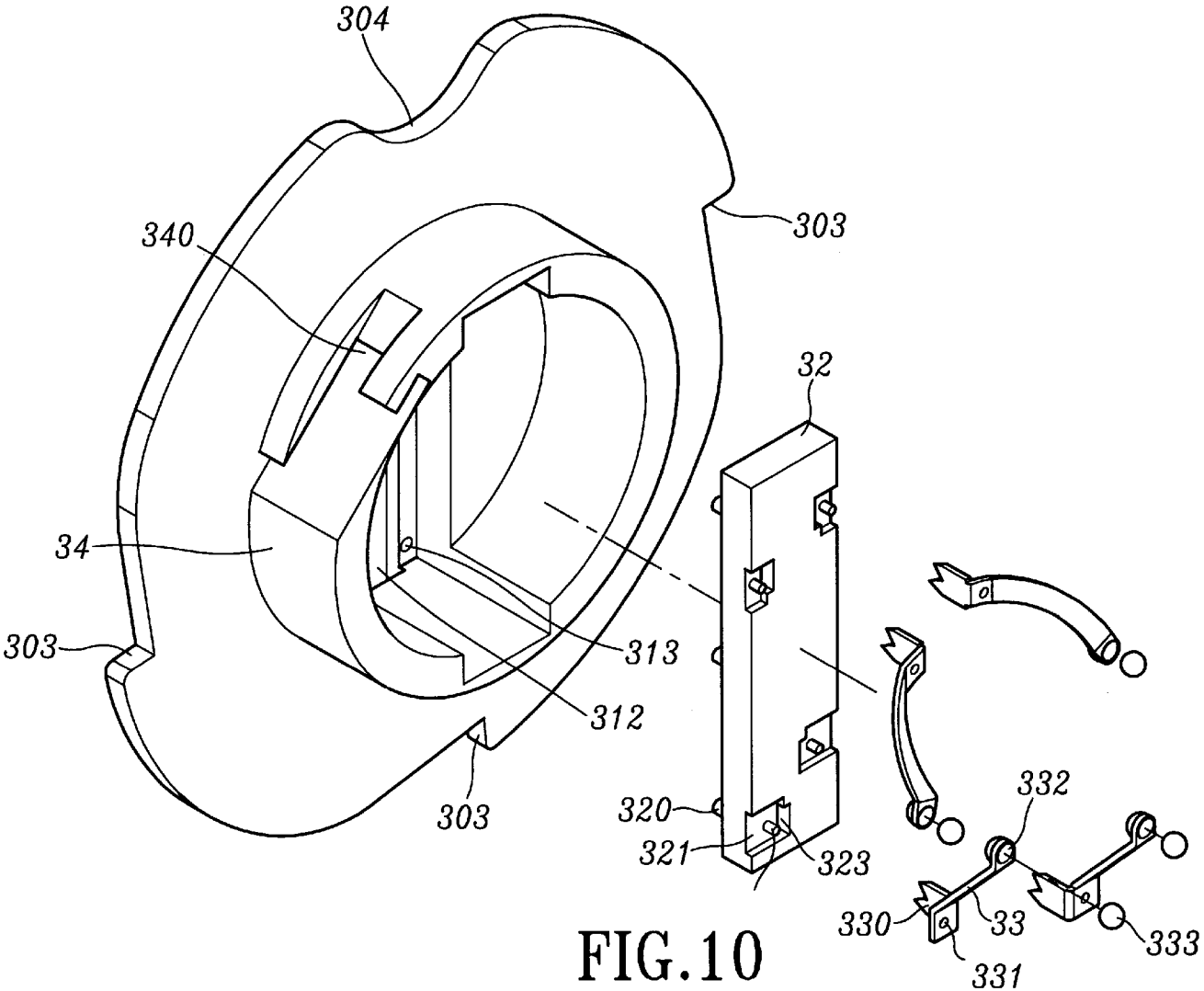
FIG. 10 is another partial perspective view illustrated the assembling of the conductive piece in another embodied application of the second embodiment according to the present invention.
Figure 11:
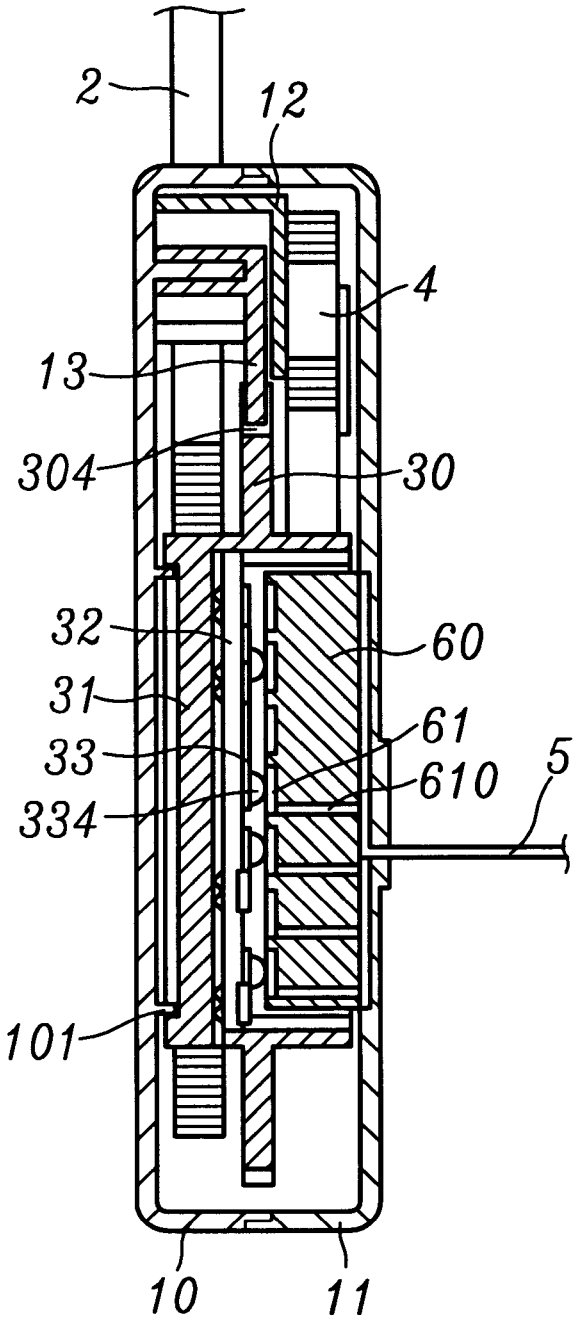
FIG. 11 is a cross sectional view showing the structure of the second embodiment.

Each inner end of the conductive piece 33 is formed with a fork 330 and has a positioning hole 331 for being inserted into the through hole 323 and being inserted by the respective conductive wire of the first communication cable 2, respectively, so as to be installed on the positioning post 322 and then fixed to the positioning groove 321. Thus, the outer end of the conductive piece 33 can be inserted into the through hole 300 so as to be extended to several places in different radius. As the first embodiment shown in FIG. 3 and the second embodiment shown in FIG. 9, the outer end of each conductive piece 33 is punched to form with a convex portion 334, or as the first embodiment shown in FIG. 4, and the another embodiment shown in FIG. 10, a concave portion 332 is punched for receiving a metal rolling ball 333 therewithin, as that shown in FIGS. 5 and 11.

Besides, the front side of the disk 30 of the firsts conductive disk 3 different from the side facing to the bearing seat is formed with a convex ring 34 one side of which is installed with a buckling groove 340 so that the buckling end of the aforementioned spiral spring 40 can be buckled therein and can be wound on the convex ring 34 at a proper time.

The second conductive disk 6 is movably received within the convex ring 34 of the first conductive disk 3 and a plurality of convex post 600 are installed for being inserted into the respective concave holes 111 of the second housing 11. One side of the disk 60 of the second conductive disk has a plurality of concentric trenches 601 with unequal diameters. Each trench 601 has a respect positioning hole 602 so that the metal conductive rings with different diameters and each having positioning piece 610 are embedded into a respective trench 601, thus the positioning piece 610 is inserted into the positioning hole 602 for being fixed therewithin and is inserted into the respective conductive wire in the second communication cable 5. Each conductive ring 61 is retained to be continuously contacted with the conductive piece 33 even in rotation.

Figure 6:
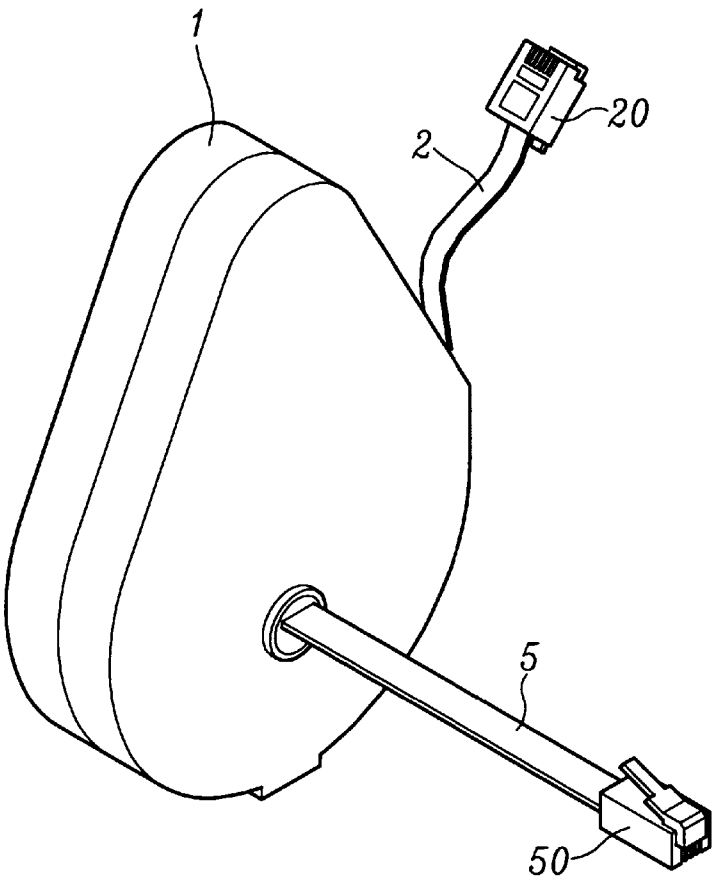
FIG. 6 is a perspective view of the structure of the wire winding box according to the present invention.

Accordingly, a wire winding box as shown in FIG. 6 is assembled. In application, the wire winding box serves to wind and receive a proper length of the first communication cable 2 and the first communication cable can be rewound. The plug 50 of the second communication cable 5 is inserted into the receiver of a telephone for replacing the conventional spring type telephone wire. The first communication cable 2 can be pulled out from the wire winding box. Moreover, by the action of the spiral spring 4 within the wire winding box, the first communication cable 2 acts rewinding force acting thereon. During the process that the receiver of a telephone is placed back to the telephone mainframe, the cable will be rewound into the box. Therefore, the wire will not protrude out and be intricate.

Figure 13:
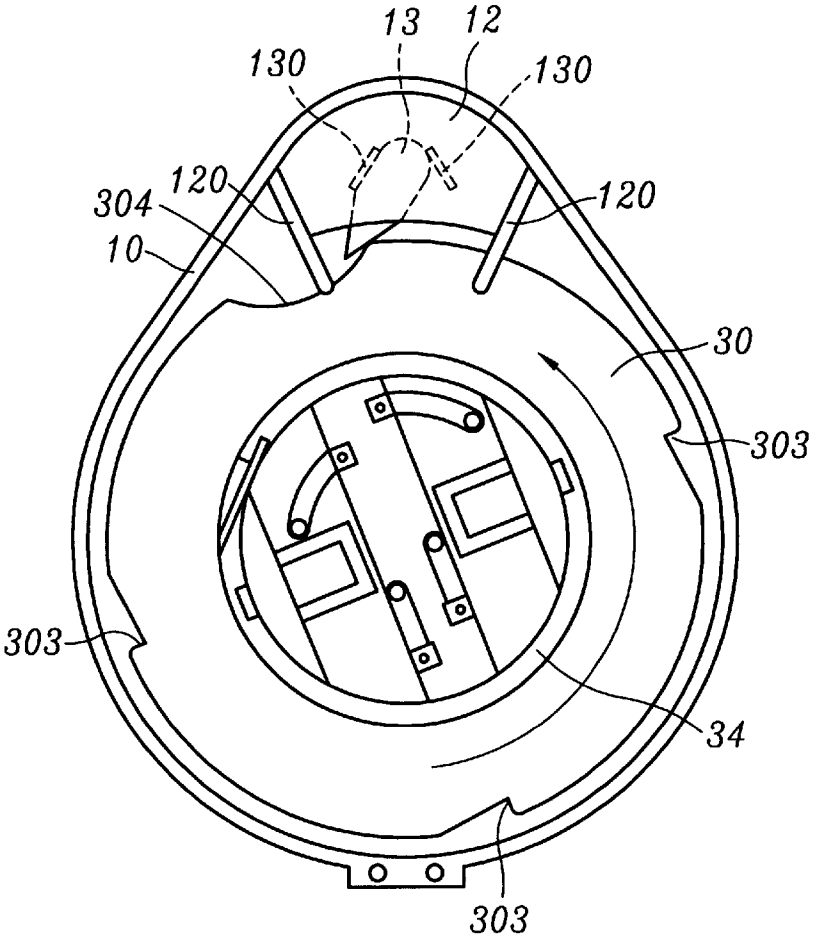
FIG. 13 is a structural plane view showing that in the present invention, a buckling block is dropped to the notch of the first conductive disk.
Figure 12:
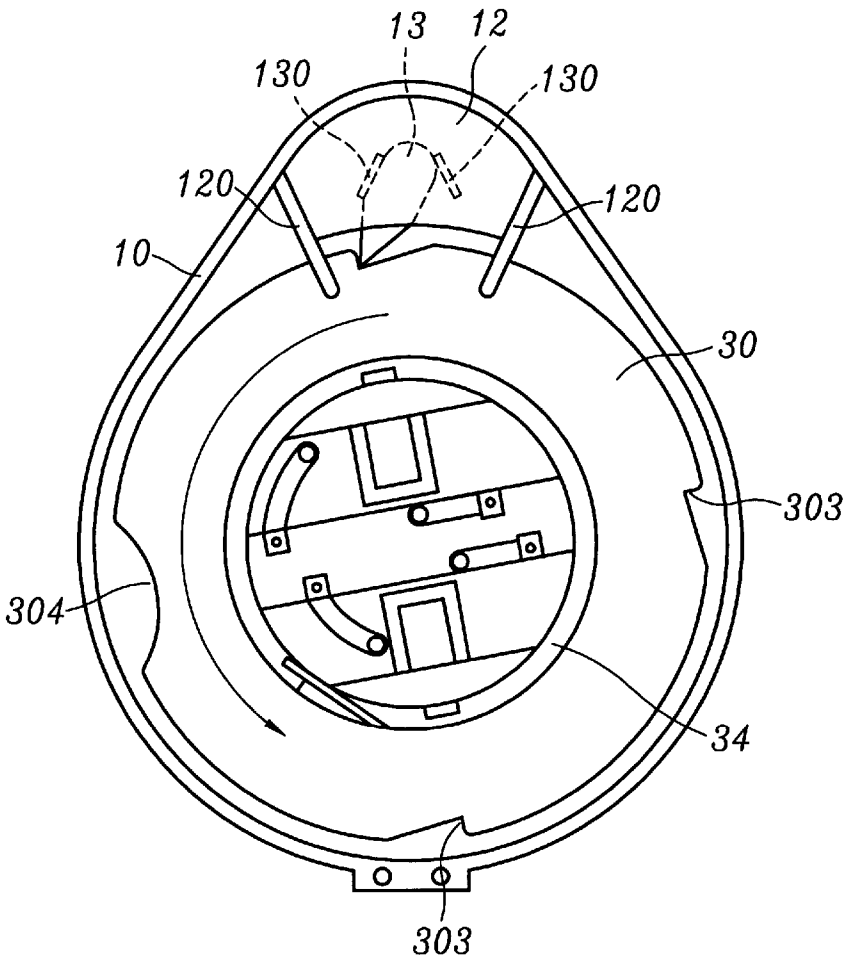
FIG. 12 is a structural plane view showing that in the present invention, the buckling groove of the first conductive disk is braked by a buckling block.
Figure 14:
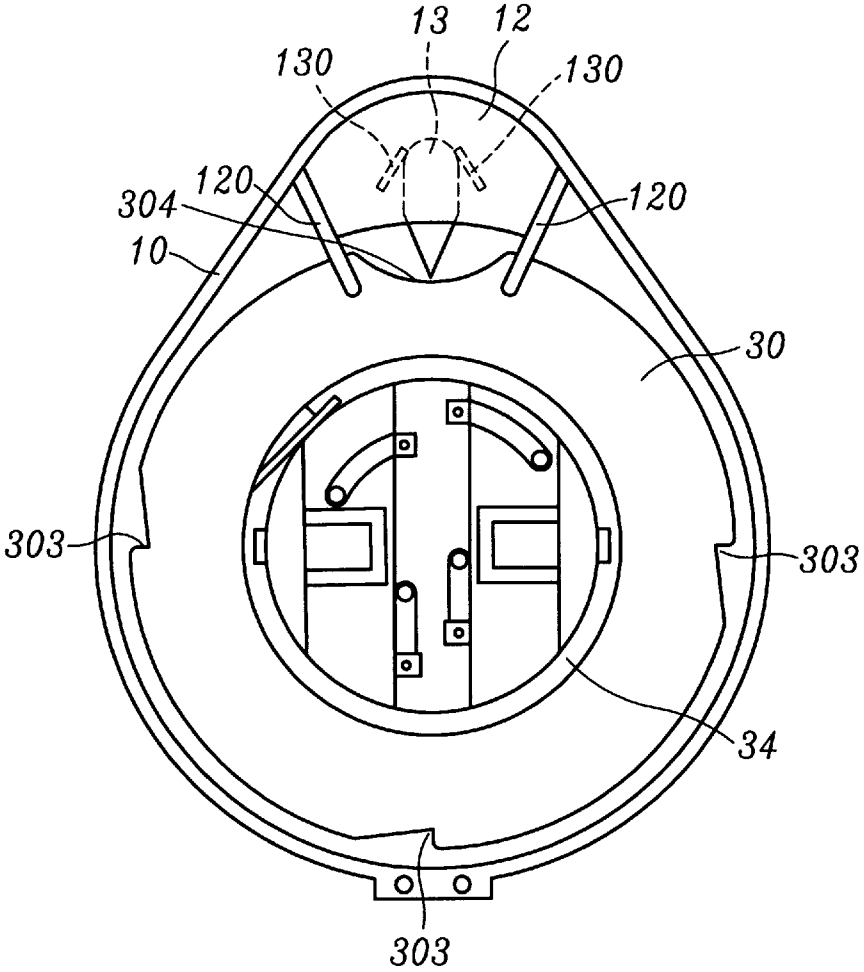
FIG. 14 is a structural plane view showing that in the present invention, a buckling block is dropped to the notch of the first conductive disk and will convert its direction.
Figure 16:
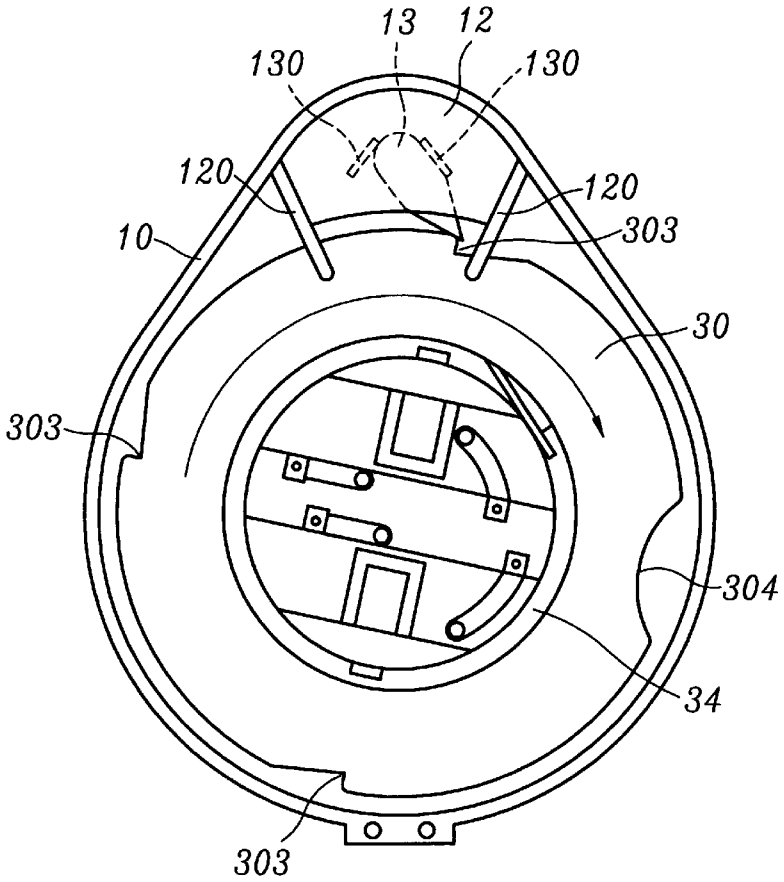
FIG. 16 is a structural plane view showing that the first conductive disk are rotated freely.
Figure 15:
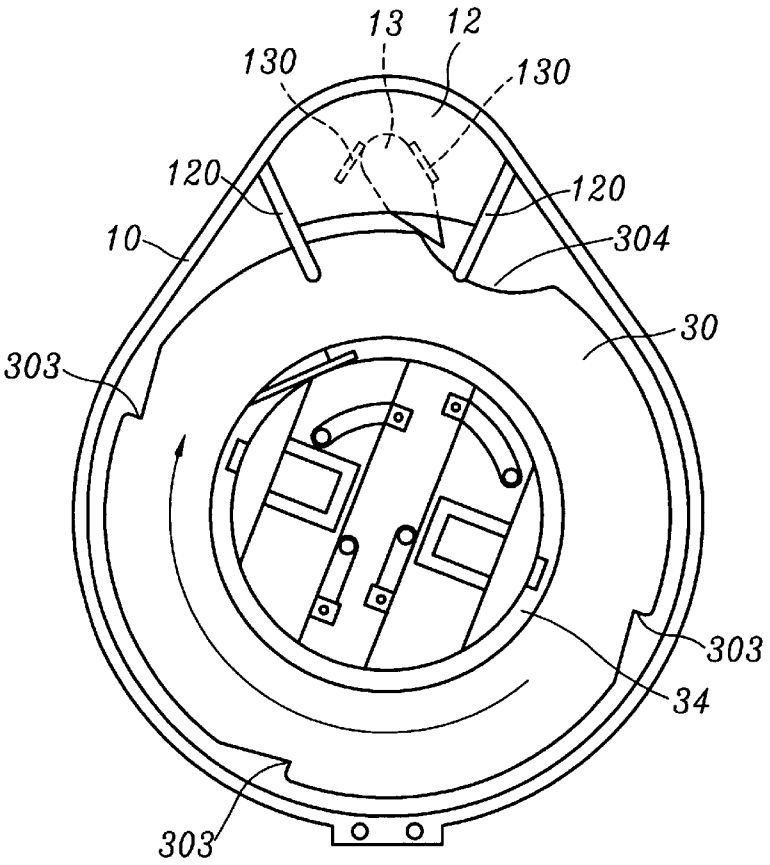
FIG. 15 is a structural plane view showing that in the present invention, a buckling block is dropped to the notch of the first conductive disk and have been converted its direction.

Since the first communication cable 2 is effected by a tension force as it is pulled out, a fiber buckling block 13 is installed at the bottom of the pad 12 of the first housing 10. Two elastic stoppers 130 with a V shape are installed at two sides of the buckling block 13. At least one inclined buckling groove 303 and one cambered notch 304 are formed at edge of the disk 30 of the first conductive disk 3. When the first communication cable 2 is pulled out so that the conductive disk 3 rotates counterclockwise, the buckling block 13 will be driven by the friction with the edge of the disk 30 to tilt leftwards so as to resist against the left side elastic stopper 130. If it rotates continuously, no buckling effect will occur to the buckling groove 303 and the notch 304. However, if the cable is stopped to be pulled out so as to be rewound by the spiral spring 4, then the buckling block 13 will embed into one buckling groove 303 to generate a braking effect (as shown in FIG. 12). Namely, after the user pulls the first communication cable 2 with a proper length, the length can be fixed temporarily. When the first communication cable 2 is desired to be rewound completely, it is only necessary to pull the wire so that the cambered notch 304 moves toward the tip of the buckling block 13, as shown in FIG. 13, then the cable is released for winding, as shown in FIGS. 14 and 15, then the buckling block 13 is dropped into the notch 304. Then by the elastic force of the elastic stopper 130, the buckling block 13 will move rightwards, and then by pushing of the disk 30, it will resist against the right side elastic stopper 130. Then, even all buckling grooves 303 pass through, as shown in FIG. 16, no buckling effect will generate. Thus, the first conductive disk 3 rewinds the first communication cable 2 rapidly and directly.

Figure 17:
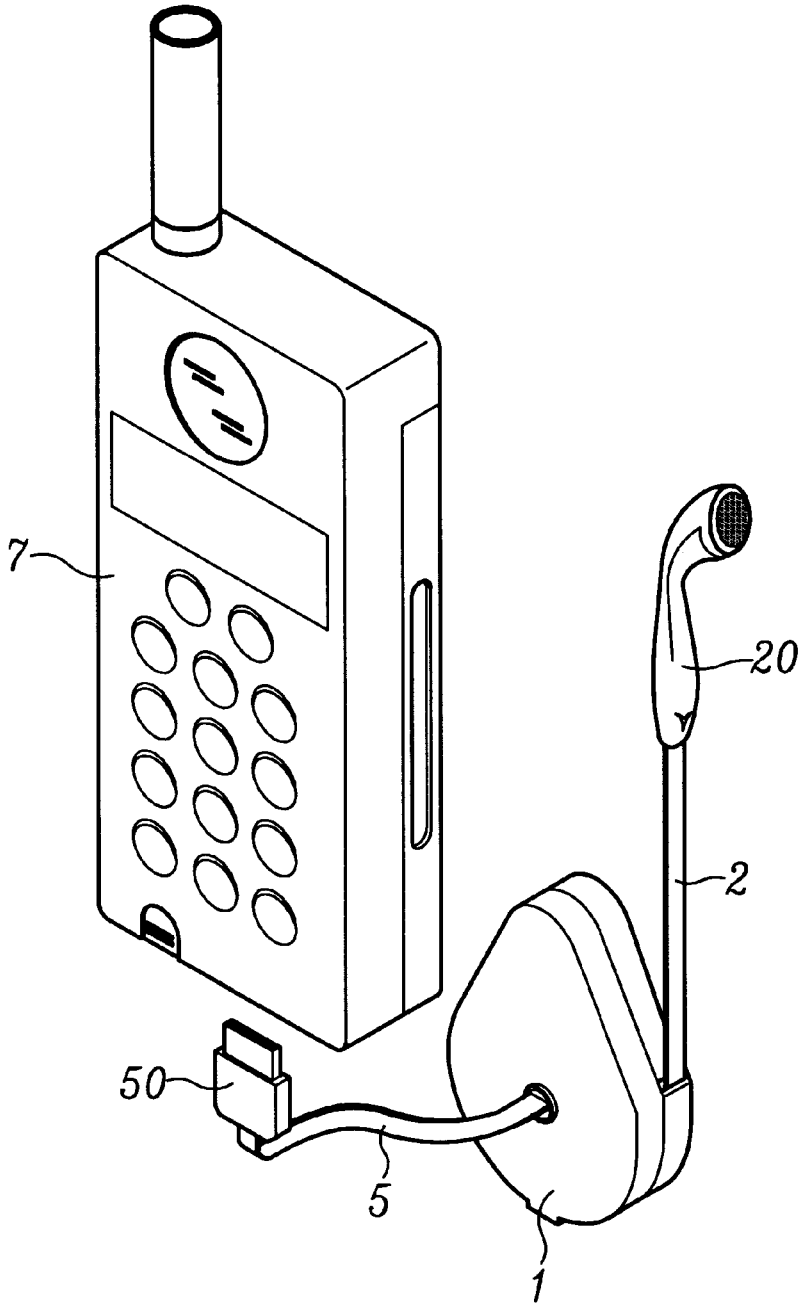
FIG. 17 shows the application that the present invention is applied to a mobile phone.
Figure 18:
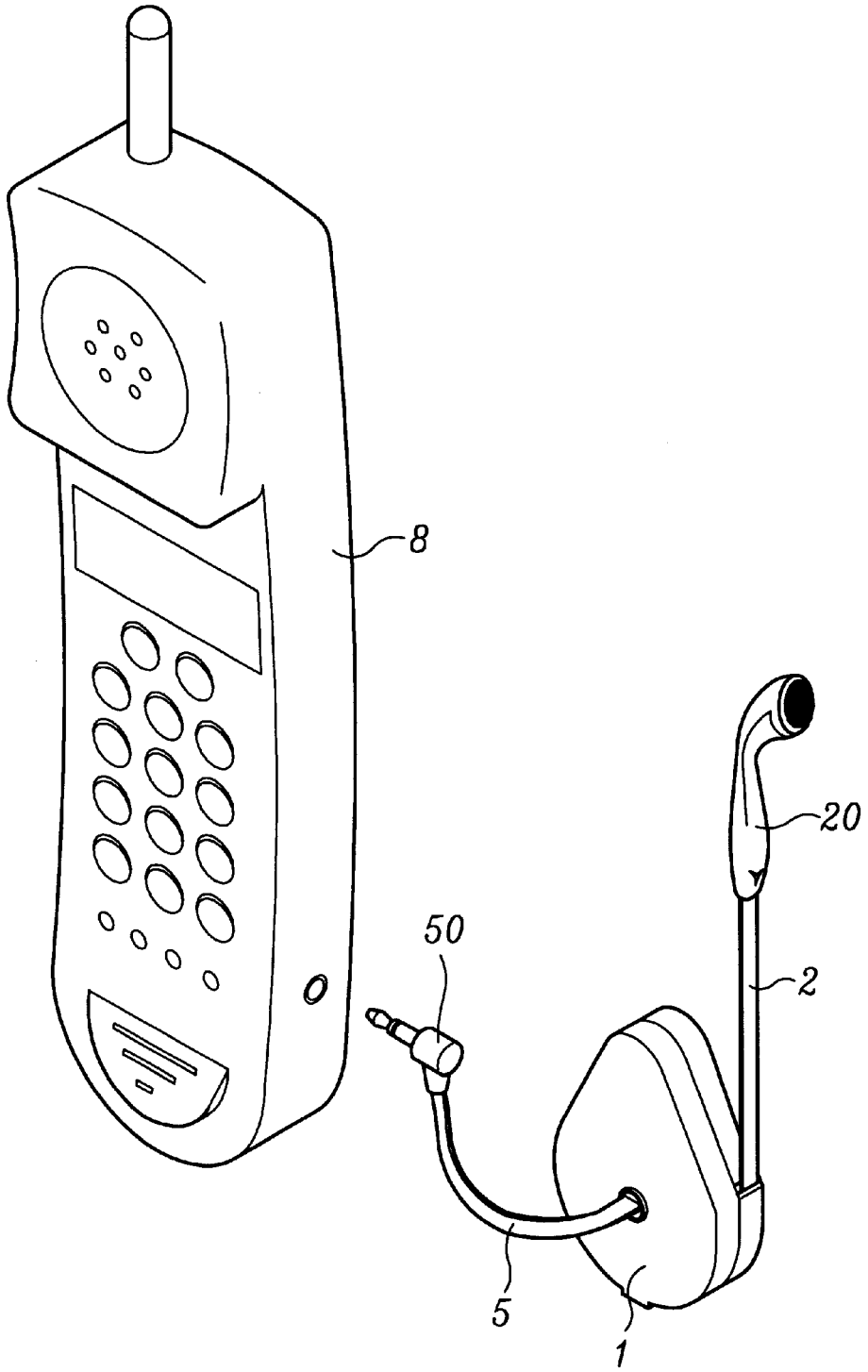
FIG. 18 shows another application that the present invention is applied to a wireless telephone.
Figure 19:
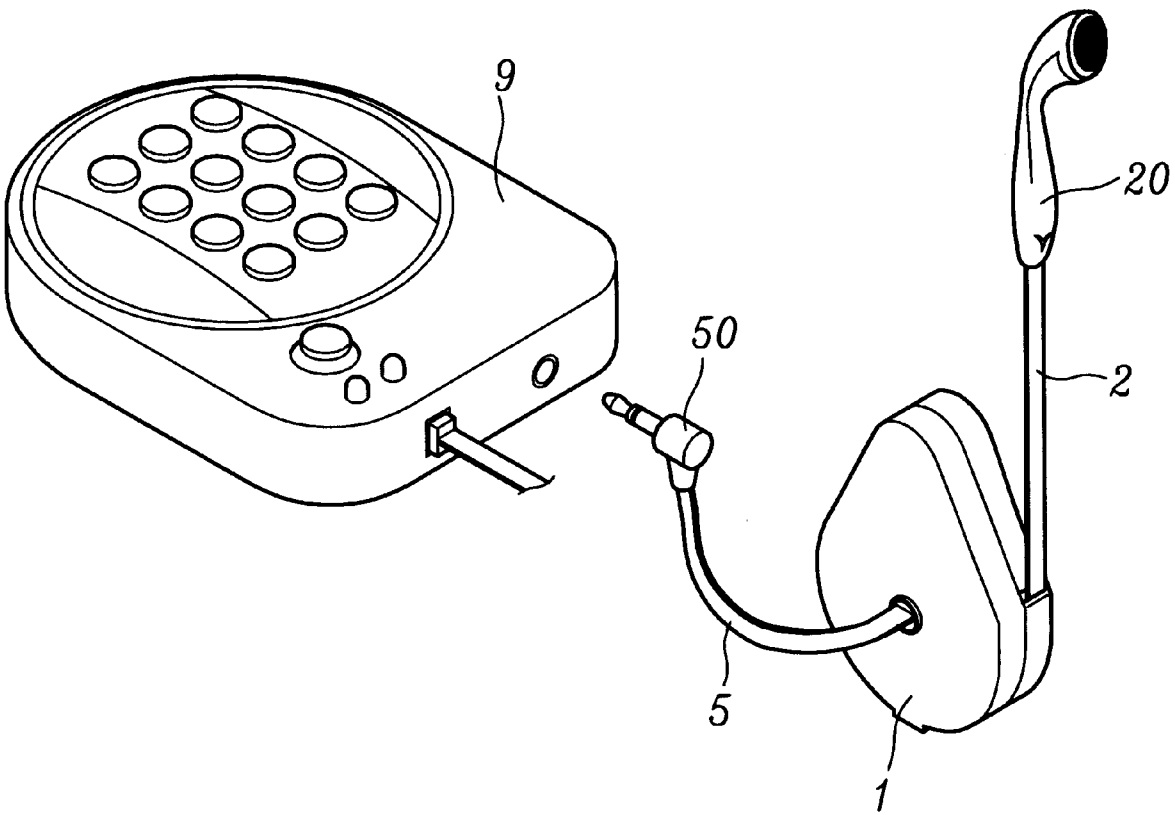
FIG. 19 shows another application that the present invention is applied to a telephone without needing to hold a receiver.

Thereby, by the special design of the conductive piece 33 of the first conductive disk 3, the structure is steadier and easily assembled, further, communication quality and cost is saved. In other hand, as the first communication cable 2 is pulled out with a predetermined length, a buckling effect is generated so that the first communication cable is temporarily fixed in that length. Furthermore, as the first communication cable 2 is further pulled with another length, the buckling effect is released. Referring to the embodiment shown in FIG. 17, another embodiment of the present invention is illustrated. The above plug 50 is replaced by an earphone 20' with a microphone, and the type of plug 50 is changed for being used in a mobile phone. Referring to the embodiment shown in FIG. 17, an embodiment is illustrated wherein the present invention is used in a wireless phone 8. Referring to FIG. 19, a further embodiment of the present invention is illustrated, wherein the present invention is used in a telephone 9 without needing to hold a receiver, even the wire winding box is wholly integrated to the battery chamber of a mobile phone.

Although the present invention has been described using specified embodiment, the examples are meant to be illustrative and not restrictive. It is clear that many other variations would be possible without departing from the basic approach, demonstrated in the present invention.

What is claimed is:

1. An improved structure of a wire winding box comprising:

a housing formed by a first housing, and a second housing;

a first communication cable passing through a line hole of the first housing, the outer end of the first communication cable being installed with a plug;

a first conductive disk received within the second housing and rotatable freely, a bearing seat for being wound by the first communication cable and being combined to the lower side of a central through hole of a disk of the first conductive disk, and another side opposite to the side facing the bearing seat being formed with a convex ring, a wire groove in the radial direction of the bearing seat is installed in the bearing seat for being inserted by the fist communication cable and for fixing a positioning block, two side of the positioning block is alternatively arranged with a plurality of elastic conductive pieces each connected to the respective cable of the radiating cover, and the outer end of each conductive piece being inserted into the through hole and positioned in different radial positions;

a spiral spring being received within one side of the first housing, and one end of the spiral spring being fixed to a buckling groove of the convex ring of the first conductive disk so as to wind around the convex ring of the first conductive disk;

a second communication cable penetrated through the line hole of the first housing, the outer end of the second communication cable being installed with a plug;

a second conductive disk being fixed inside the second housing and received within the convex ring of the first conductive disk, the side of the second conductive disk adjacent to the first conductive disk being installed with a plurality of concentric conductive rings with different diameters for contacting with the outer ends of the respective conductive pieces in the first conductive disk, and the each conductive ring being connected to the respective conductive wires of the second communication cable.

2. The improved structure of the wire winding box as claimed in claim 1, wherein the outer end of each conductive piece of the first conductive disk contacted with respective conductive ring of second conductive disk is formed with a concave portion, metal rolling balls are arranged within the concave portions for being in contact with the respective conductive ring of second conductive disk.

3. The improved structure of the wire winding box as claimed in claim 1, wherein the end that each conductive piece of the first conductive disk contact with respective conductive ring of second conductive disk is installed with a convex portion for being in contact with the respective conductive ring of second conductive disk.

4. The improved structure of the wire winding box as claimed in claim 1, wherein a pad is installed at the lateral side of the first housing, the pad and the wall of the housing are formed with a space for receiving a spiral spring.

5. The improved structure of the wire winding box as claimed in claim 1, wherein a round ring is formed at the center of the lateral surface of the first housing for pivotally and rotatably engaging with the bearing seat of the first conductive disk.

6. The improved structure of the wire winding box as claimed in claim 1, wherein buckling holes and positioning holes are formed at two sides of one line passing through the central through hole of first conductive disk, and hooks and positioning blocks are located at two sides of a diameter line on a bearing seat, thereby, the bearing seat is engaged to the disk body of the first conductive disk.

7. The improved structure of the wire winding box as claimed in claim 1, wherein the inner end of each conductive piece on the positioning block of the first conductive disk is formed with a fork end and has a positioning hole, two sides of the positioning block are alternatively arranged with positioning grooves, each positioning groove is installed with positioning post and through holes are formed therewithin so that each conductive piece is inserted into the through hole by the fork end so as to insert the first communication cable to the respective conductive wire, thus, the positioning post being inserted into the positioning hole and is combined therewith.

8. The improved structure of the wire winding box as claimed in claim 1, wherein at least one buckling groove and one notch are formed at an edge of the disk of the first conductive disk, buckling blocks are pivotally installed on the bottom of the pad of the first housing, each buckling block freely rotates to the edge of the disk and slides into the buckling groove or into the notch, each of the two sides of the buckling block is installed with an elastic stopper.

9. An improved structure of a wire winding box comprising:

a housing formed by a first housing, and a second housing;

a first communication cable passing through a line hole of the first housing, the outer end of the first communication cable being installed with a plug;

a first conductive disk received within the second housing and rotatable freely, a bearing seat for being wound by the first communication cable being integrally formed with of the first conductive disk, and another side opposite to the side facing the bearing seat being formed with a convex ring, a wire groove in the radial direction of the bearing seat is installed in the bearing seat for being inserted by the first communication cable and for fixing a positioning block, two side of the positioning block is alternatively arranged with a plurality of elastic conductive pieces each connected to the respective cable of the radiating cover, and the outer end of each conductive piece being inserted into the through hole and positioned in different radial positions;

a spiral spring being received within one side of the first housing, and one end of the spiral spring being fixed to the buckling groove of the convex ring of the first conductive disk so as to wind around the convex ring of the first conductive disk;

a second communication cable penetrated through the line hole of the first housing, the outer end of the second communication cable being installed with a plug;

a second conductive disk being fixed inside the second housing and received within the convex ring of the first conductive disk, the side of the second conductive disk adjacent to the first conductive disk being installed with a plurality of concentric conductive rings with different diameters for contacting with the outer ends of the respective conductive pieces in the fist conductive disk, the each conductive ring is connected to the respective conductive wires of the second communication cable.

10. The improved structure of the wire winding box as claimed in claim 9, wherein the outer end of each conductive piece of the first conductive disk contacted with respective conductive ring of second conductive disk is formed with a concave portion, metal rolling balls are arranged within the concave portion for being in contact with the respective conductive ring of second conductive disk.

11. The improved structure of the wire winding box as claimed in claim 9, wherein the end that each conductive piece of the first conductive disk contact with respective conductive ring of second conductive disk is installed with a convex portion for being in contact with the respective conductive ring of second conductive disk.

12. The improved structure of the wire winding box as claimed in claim 9, wherein a pad is installed at the lateral side of the first housing, the pad and the wall of the housing are formed with a space for receiving a spiral spring.

13. The improved structure of the wire winding box as claimed in claim 9, wherein a round ring is formed at the center of the lateral surface of the first housing for pivotally and rotatably engaging with the bearing seat of the first conductive disk.

14. The improved structure of the wire winding box as claimed in claim 9, wherein the inner end of each conductive piece on the positioning block of the first conductive disk is formed with a fork end and has a positioning hole, two sides of the positioning block are alternatively arranged with positioning grooves, each positioning groove is installed with positioning post and through holes are formed therewithin so that each conductive piece is inserted into the through hole by the fork end so as to insert the first communication cable to the respective conductive wire, thus, the positioning post being inserted into the positioning hole and is combined therewith.

15. The improved structure of the wire winding box as claimed in claim 9, wherein at least one buckling groove and one notch are formed at edge of the disk of the fist conductive disk, buckling blocks are pivotally installed on the bottom of the pad of the first housing, each buckling block freely rotates to the edge of the disk and slides into the buckling groove or into the notch, each of two sides of the buckling block is installed with an elastic stopper.

* * * * *